US005511901A

United States Patent [19]

Yates

[11] Patent Number: 5,511,901

[45] Date of Patent: Apr. 30, 1996

[54] REMOVABLE PADFOOT SHELL CONVERSION DEVICE

[75] Inventor: Steve K. Yates, Scotland, Pa.

[73] Assignee: Ingersoll-Rand Company, Woodcliff Lake, N.J.

[21] Appl. No.: 329,013

[22] Filed: Oct. 25, 1994

[51] Int. Cl.[6] ..... E01C 19/26

[52] U.S. Cl. ..... 404/124

[58] Field of Search ..... 404/124, 128, 404/129, 89

[56] References Cited

U.S. PATENT DOCUMENTS

| | | | |
|---|---|---|---|
| 2,410,465 | 11/1946 | Small . | |
| 2,484,285 | 10/1949 | Greiner . | |
| 2,741,968 | 4/1956 | Harris . | |
| 3,450,013 | 6/1969 | Peterson . | |
| 3,603,226 | 9/1971 | Marcovitch . | |
| 3,610,116 | 10/1971 | Viefhaus . | |
| 3,623,406 | 11/1971 | Leben . | |
| 3,989,404 | 11/1976 | Burton . | |
| 4,219,287 | 8/1980 | Marks . | |
| 4,348,134 | 9/1982 | Goehler . | |
| 4,632,599 | 12/1986 | Sadahiro . | |
| 4,858,697 | 8/1989 | Sherblom . | |
| 5,228,799 | 7/1993 | Sondreal | 404/124 |
| 5,360,288 | 11/1994 | O'Neill et al. | 404/129 |
| 5,421,670 | 6/1995 | Meirick | 404/124 |

*Primary Examiner*—William P. Neuder
*Attorney, Agent, or Firm*—John J. Selko

[57] ABSTRACT

A roller drum construction for a compacting machine includes a cylindrical primary drum with an arcuate outer surface for contacting material to be compacted; a removable shell for changing the outer surface of the primary drum from a planar to a padfoot surface, the removable shell being flexibly deformed into frictional engagement with the outer surface of the primary drum.

6 Claims, 1 Drawing Sheet

REMOVABLE PADFOOT SHELL CONVERSION DEVICE

BACKGROUND OF THE INVENTION

This invention relates generally to soil compactors, and more particularly to devices for changing the outer surface of compactor drums from a planar surface to a padfoot surface.

Presently, removable shells for changing the outer surface of drums require that the removable shell be bolted to the drum. This requires alignment of the removable shell sections with bolt holes in the drum and is otherwise time consuming to complete the conversion.

The foregoing illustrates limitations known to exist in present compactor drum constructions. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a roller drum construction for a compacting machine comprising: a cylindrical primary drum with an arcuate outer surface for contacting material to be compacted; a removable shell for changing the outer surface of the primary drum from a planar to a padfoot surface further comprising: a plurality of flexible arcuate mounting members curved to approximate the arcuate curvature of the outer surface of the primary drum; a padfoot outer surface on said mounting members; and means for connecting said mounting members to each other around the outer surface of the primary drum and for flexibly deforming said mounting members into frictional engagement with the outer surface of said primary drum.

The foregoing and other aspects will become apparent from the following detailed description of the invention when considered in conjunction with the accompanying drawing figures.

BRIEF DESCRIPTION OF THE DRAWING FIGURES

FIG. 1 is an exploded schematic view of the drum construction of the invention.

DETAILED DESCRIPTION

Figure 1:
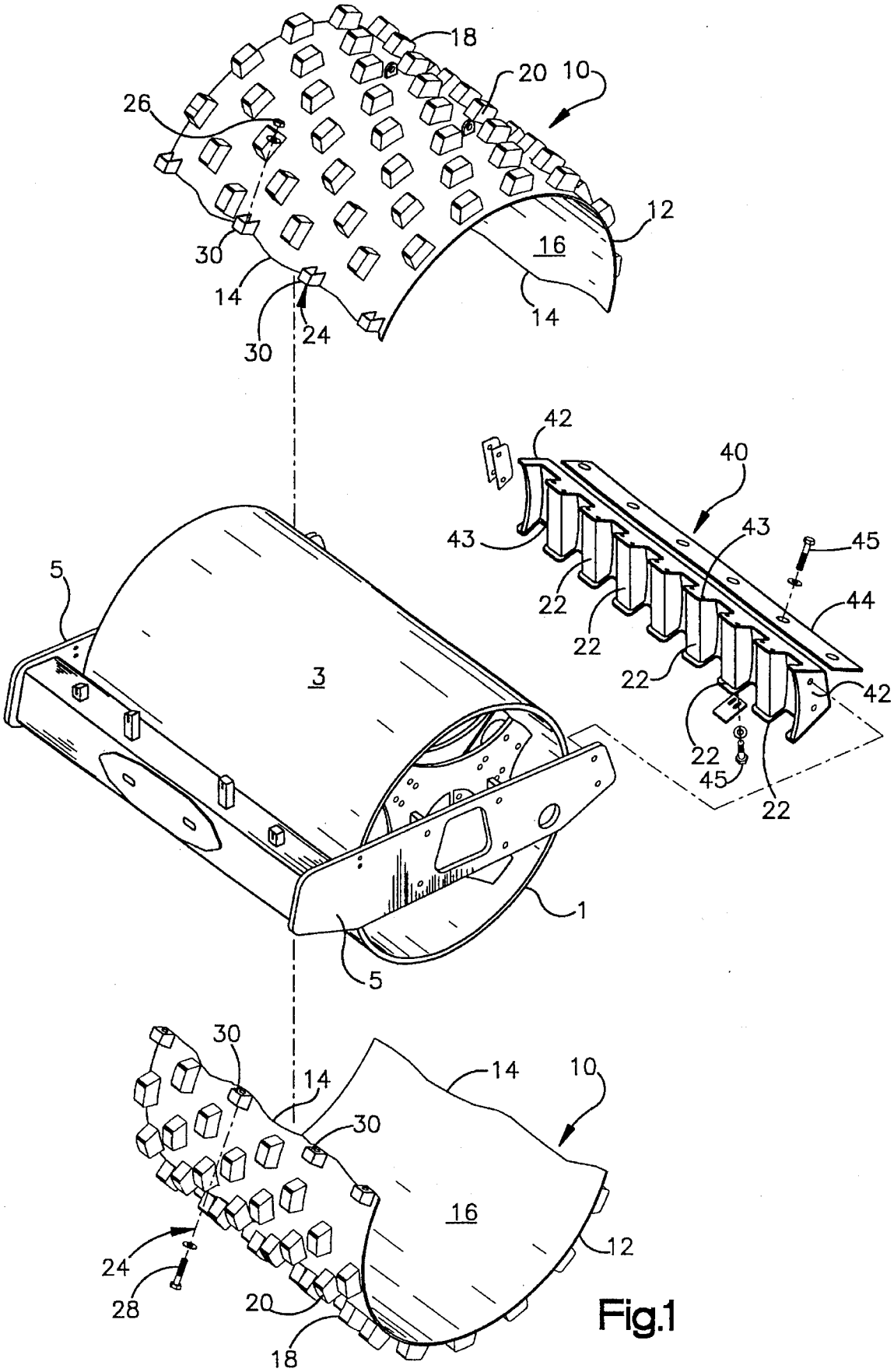

FIG. 1 shows a primary drum 1 having an arcuate outer surface 3 that is planar. Drum 1 is rotatably mounted on support members 5, which are mounted on a frame of a mobile drum compacting machine (not shown) of conventional design. Drum 1 is usually driven by conventional means and includes conventional vibration devices therein to assist in compaction.

A removable padfoot shell is formed from a plurality of flexible arcuate mounting members 10 that are curved to approximate the arcuate curvature of the outer surface of the primary drum 1. Each mounting member 10 is a flexible plate member 12 terminating in a pair of spaced-apart longitudinal connection edges 14. Each plate member 12 has a planar inner surface 16 and a padfoot outer surface 18. Each padfoot 20 is welded to the outer surface of plate member 12, and extends generally radially outwardly therefrom to act as a tamper foot on the material being compacted. The actual spacing and arrangement of the padfeet is optional, so long as spacing is provided to permit scraper teeth 22 to pass between adjacent padfeet, as the primary drum 1 drum rotates.

Means for connecting mounting members 10 around the primary drum 1 are a plurality of removable fastener means 24, preferably a nut and bolt combination, spaced longitudinally along connection edges 14 of plate members 12. Nuts 26 and bolts 28 connect adjacent mounting pads 30. Each mounting pad 30 is one-half the arcuate length of a single padfoot 20, so that when nuts 26 and bolts 28 are drawn together, mounting pads 30 contact each other and form a single padfoot 20. Mounting members 10 are also forced into frictional contact against outer surface 3 of drum 1, in effect "squeezing" drum 1. I prefer two semi-circle mounting members 10, but three or more arcuate sections can also work.

The scraper system is shown generally as 40. A scraper bar 42 is bolted to the front of the machine and extends between frame members 5. Scraper bar 42 includes a top and bottom serrated mounting surface 43. When the padfeet shell is in place, a plurality of scraper teeth 22 are individually bolted to mounting surfaces 43 of scraper bar 42 by bolts 45. When the primary drum 1 is planar, scraper teeth 22 are removed and stored in a convenient place on the machine. A pair of planar scraper plates 44, which have been also stored on the machine, are now bolted to top and bottom mounting surfaces 43 of scraper bar 42 by bolts 45.

While I have shown the primary drum 1 having a planar outer surface 3 and the removable shell having a padfoot outer surface 18, the reverse arrangement would work. That is, primary drum 1 can be have a padfoot outer surface and removable shell can have a planar outer surface. Inner surface of the removable shell can be either planar or padfoot, with padfeet arranged to fit between the padfeet of primary drum 1.

Having described the invention, what is claimed is:

1. A roller drum construction for a compacting machine comprising:

a. a cylindrical primary drum with an arcuate outer surface for contacting material to be compacted;

b. a removable shell for changing the outer surface of the primary drum from a planar to a padfoot surface comprising:

i. a plurality of flexible arcuate mounting members curved to approximate the arcuate curvature of the outer surface of the primary drum;

ii. a padfoot outer surface on said mounting members; and iii. means for connecting said mounting members to each other around the outer surface of the primary drum and for flexibly deforming said mounting members into frictional engagement with the outer surface of said primary drum.

2. For use in a drum compactor having a cylindrical primary drum with an arcuate outer surface for contacting material to be compacted, a removable shell for changing the outer surface of the primary drum from a planar to a padfoot surface comprising:

a. a plurality of flexible arcuate mounting members curved to approximate the arcuate curvature of the outer surface of the primary drum;

b. a padfoot outer surface on said mounting members; and c. means for connecting said mounting members to each other around the outer surface of the primary drum and for flexibly deforming said mounting members into frictional engagement with the outer surface of said primary drum.

3. The removable shell of claim 2 further comprising:

a. each mounting member being a flexible plate member terminating in a pair of spaced-apart longitudinal connection edges;

b. a planar inner surface; and b. said padfoot outer surface comprising a plurality of individual padfeet fastened to said outer surface of said flexible plate and extending radially outwardly from said flexible plate.

4. The removable shell of claim 3 wherein said means for connecting said mounting members to each other comprises a plurality of removable fastener means spaced longitudinally along said connection edges of said plate members, for connecting two adjacent connecting edges of adjacent mounting members.

5. The removable shell of claim 4 wherein said removable fasteners comprise a bolt and nut combination spanning between two adjacent connection edges of adjacent mounting members.

6. The drum construction of claim 1 further comprising a scraper bar means for alternately supporting a padfoot scraper bar or a planar scraper bar.

* * * * *